US012434096B2

(12) United States Patent
Hunt

(10) Patent No.: US 12,434,096 B2
(45) Date of Patent: Oct. 7, 2025

(54) DEVICE FOR ENHANCING GRIP STRENGTH

(71) Applicant: Thane Robert Hunt, Worcester, MA (US)

(72) Inventor: Thane Robert Hunt, Worcester, MA (US)

( * ) Notice: Subject to any disclaimer, the term of this patent is extended or adjusted under 35 U.S.C. 154(b) by 93 days.

(21) Appl. No.: 17/819,359

(22) Filed: Aug. 12, 2022

(65) Prior Publication Data

US 2024/0050802 A1 Feb. 15, 2024

(51) Int. Cl.

| | |
|---|---|
| ***A63B 23/16*** | (2006.01) |
| ***A63B 21/00*** | (2006.01) |
| ***A63B 21/04*** | (2006.01) |
| ***A63B 23/035*** | (2006.01) |

(52) U.S. Cl.

CPC ..... *A63B 23/16* (2013.01); *A63B 21/00185* (2013.01); *A63B 21/0435* (2013.01); *A63B 21/153* (2013.01); *A63B 21/4019* (2015.10); *A63B 21/4021* (2015.10); *A63B 23/03508* (2013.01)

(58) Field of Classification Search

CPC ... A63B 23/16; A63B 21/0435; A63B 21/153; A63B 21/4019; A63B 21/4021; A61H 1/0285–0288; A61F 5/013

See application file for complete search history.

(56) References Cited

U.S. PATENT DOCUMENTS

| | | | | | |
|---|---|---|---|---|---|
| 4,644,938 | A * | 2/1987 | Yates | A61H 1/0288 | 482/901 |
| 4,772,012 | A * | 9/1988 | Chesher | A63B 23/16 | 601/40 |
| 5,348,531 | A * | 9/1994 | Brown | A63B 21/4019 | 601/40 |
| 5,447,490 | A * | 9/1995 | Fula | A63B 21/0004 | 601/40 |
| 5,538,488 | A * | 7/1996 | Villepigue | A63B 21/023 | 601/40 |
| 7,415,735 | B2 * | 8/2008 | Erickson | A41D 19/01582 | 2/163 |
| 9,387,110 | B2 * | 7/2016 | Kelly | A61F 5/0118 | |
| 2006/0247102 | A1 * | 11/2006 | Kupferman | A63B 21/0552 | 482/44 |
| 2015/0011368 | A1 * | 1/2015 | Manor | A63B 23/1209 | 482/116 |
| 2019/0126095 | A1 * | 5/2019 | Zerbo | A63B 21/153 | |

FOREIGN PATENT DOCUMENTS

| | | | | |
|---|---|---|---|---|
| CN | 101511310 A * | 8/2009 | ..... | A61F 5/013 |

* cited by examiner

*Primary Examiner* — Joshua T Kennedy
(74) *Attorney, Agent, or Firm* — PatentPC; Bao Tran

(57) ABSTRACT

A hand exercise device includes a first wrist bracelet; a second wrist bracelet removably coupleable to the first wrist bracelet; an actuator mounted on the second wrist bracelet with an extendable loop powered by the actuator; and a fingertip brace coupled to the first wrist bracelet.

18 Claims, 8 Drawing Sheets

DEVICE FOR ENHANCING GRIP STRENGTH

BACKGROUND OF THE INVENTION

People with reduced hand mobility and/or strength due to medical conditions (such as post-stroke, ALS, injury, etc.) have difficulty performing activities of daily living (ADLs). Tasks such as personal hygiene, feeding, and recreation are either more difficult or impossible without assistance from either a device or another person.

Existing methods of augmenting or creating or restoring grasping function in the hands have disadvantages such as high weight, large size, high cost, or inadequate function. For example, traditional devices (such as simple, static hand braces) do not provide a dynamic grasp force and can not hold a variety of object sizes and shapes. In short, existing passive devices are primitive designs intended for only a minimal reclamation of normal hand function. They are usually rigid and do not provide any hand movement.

Newer, electric grasping devices offer dynamic grasp force and allow objects of different sizes and shapes to be held, but they are usually heavy, high-profile, cosmetically undesirable, have to be recharged, and expensive to own. Electric grasping devices can offer more function than existing passive devices, but they weigh more, cost more, and are usually much larger. They also require dedicated activation signals, such as switches mounted near the user's chin or electromyography (EMG) sensors, which have reliability issues and require special donning and doffing practices.

Furthermore, conventional grasping devices are designed around bulky and cumbersome materials and methods, such as thick hook-and-loop, thermoformed plastic sheet, metal electric actuators, and bent sheet metal. They usually require customization services from a clinician for each user to ensure a proper fit.

SUMMARY OF THE INVENTION

According to a first aspect of the present invention, a hand exercise device includes a first wrist bracelet; a second wrist bracelet removably coupleable to the first wrist bracelet; an actuator mounted on the second wrist bracelet with an extendable loop powered by the actuator, and a fingertip brace coupled to the first wrist bracelet.

According to a second aspect, a spring-actuated or motor-actuated string/cable/cord/strap is manually attached (using the other hand, or even the user's teeth) to the ends of one or more fingers across the palm-side of the hand and the force from that string/cable/cord/strap can bend the fingers to conformally wrap around objects. It can be unpowered or powered.

According to a third aspect of the present invention, a method of holding an object is disclosed. The method includes attaching a device to a wrist, the device including a first wrist bracelet; a second wrist bracelet removably coupleable to the first wrist bracelet; an actuator mounted on the second wrist bracelet with an extendable loop powered by the actuator; and a fingertip brace coupled to the first wrist bracelet; inserting one or more fingers through the fingertip brace and the extendable loop, and exercising the one or more fingers by alternately pulling the one or more fingers into a palm and relaxing the one or more fingers.

According to a fourth aspect of the present invention, a method of exercising one or more fingers is disclosed. The method includes attaching a hand exercise device to a wrist, the hand exercise device including a first wrist bracelet; a second wrist bracelet removably coupleable to the first wrist bracelet; an actuator mounted on the second wrist bracelet with an extendable loop powered by the actuator; and a fingertip brace coupled to the first wrist bracelet; inserting one or more fingers through the fingertip brace and the extendable loop, and exercising the one or more fingers by alternately pulling the one or more fingers into a palm and relaxing the one or more fingers.

Advantages of the above aspects may include one or more of the following. The device provides a dynamic grasp force while holding a variety of object sizes and shapes. Exercises with the device enable the reclamation of normal hand function. The device is flexible and supports hand movement. The device is slim, lightweight and low-profile, cosmetically attractive, does not need charging, and inexpensive to own. Rehabilitation can be done without a dedicated activation signal, such as a switch mounted near the user's chin or electromyography (EMG) sensors, which have reliability issues and require special donning and doffing practices. Due to the slim and easy-to-adjust features, the device can be used without any customization services from a clinician for each user to ensure a proper fit.

Figure 1:
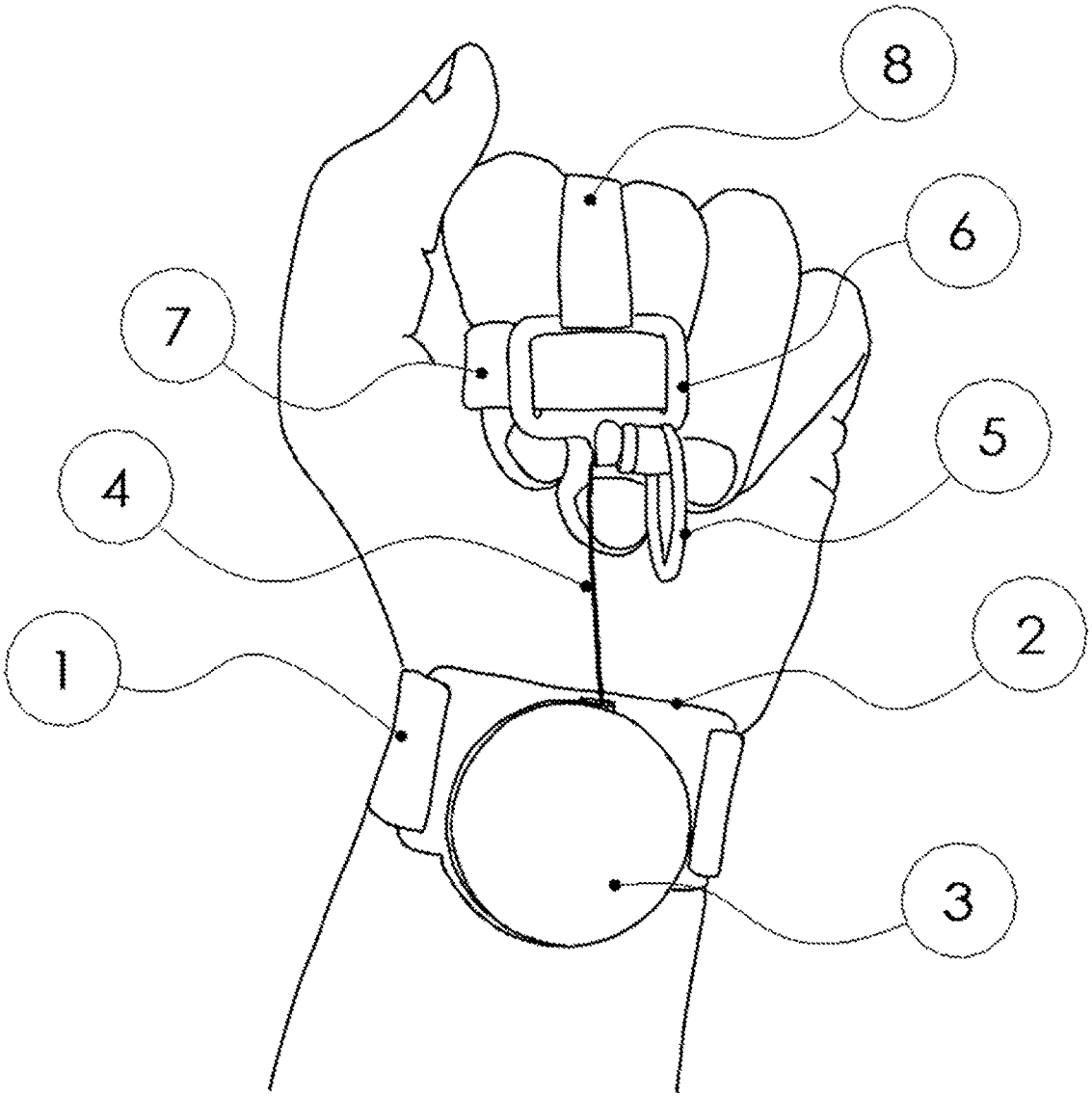
FIG. 1 shows an exemplary grip exercise device on a hand according to one embodiment of the invention.

Further applications and advantages of various embodiments of the present invention are discussed below with reference to the drawing figures.

Figure 2:
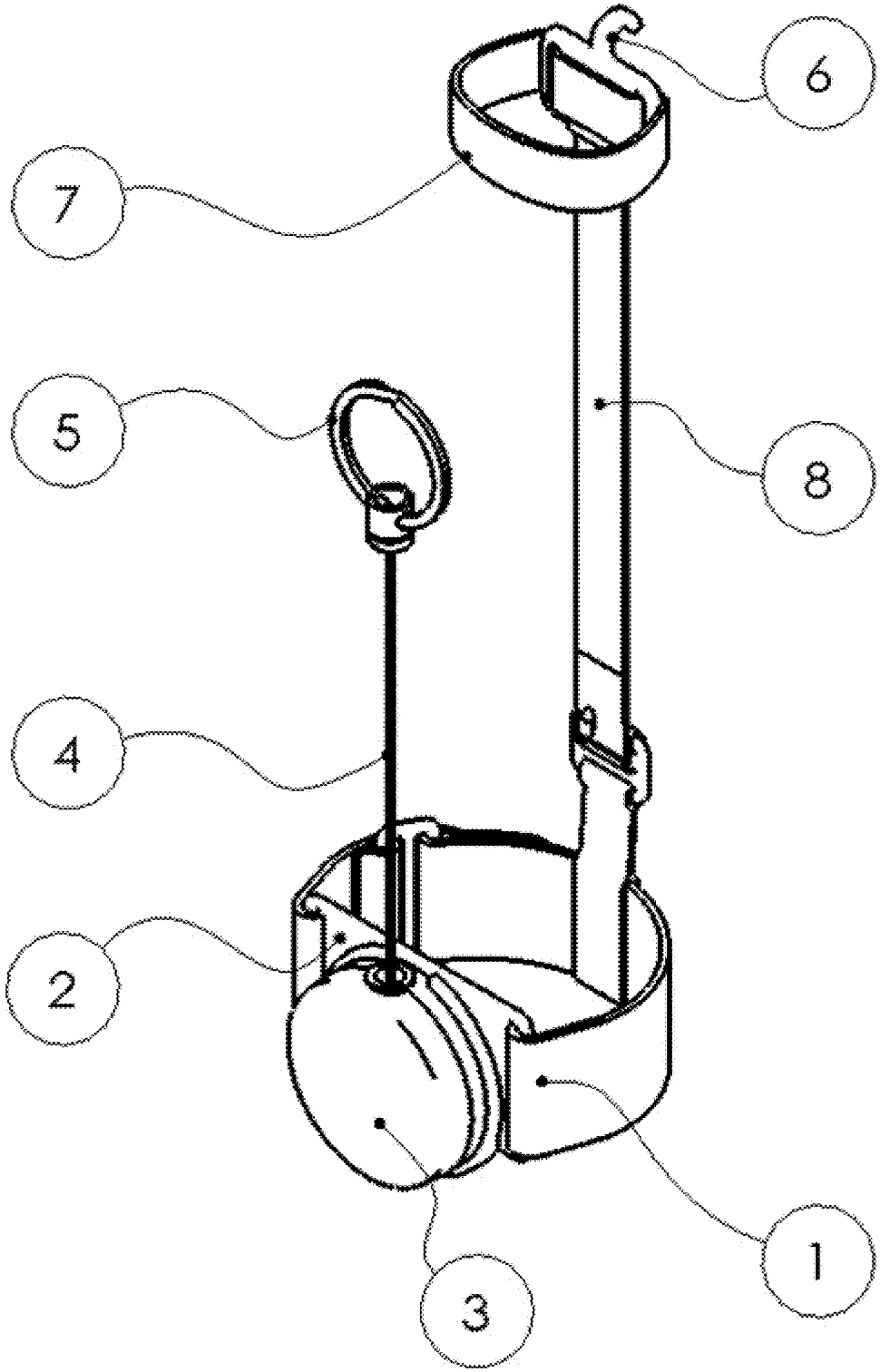
FIG. 2-7 are exemplary views of the device of FIG. 1.
Figure 3:
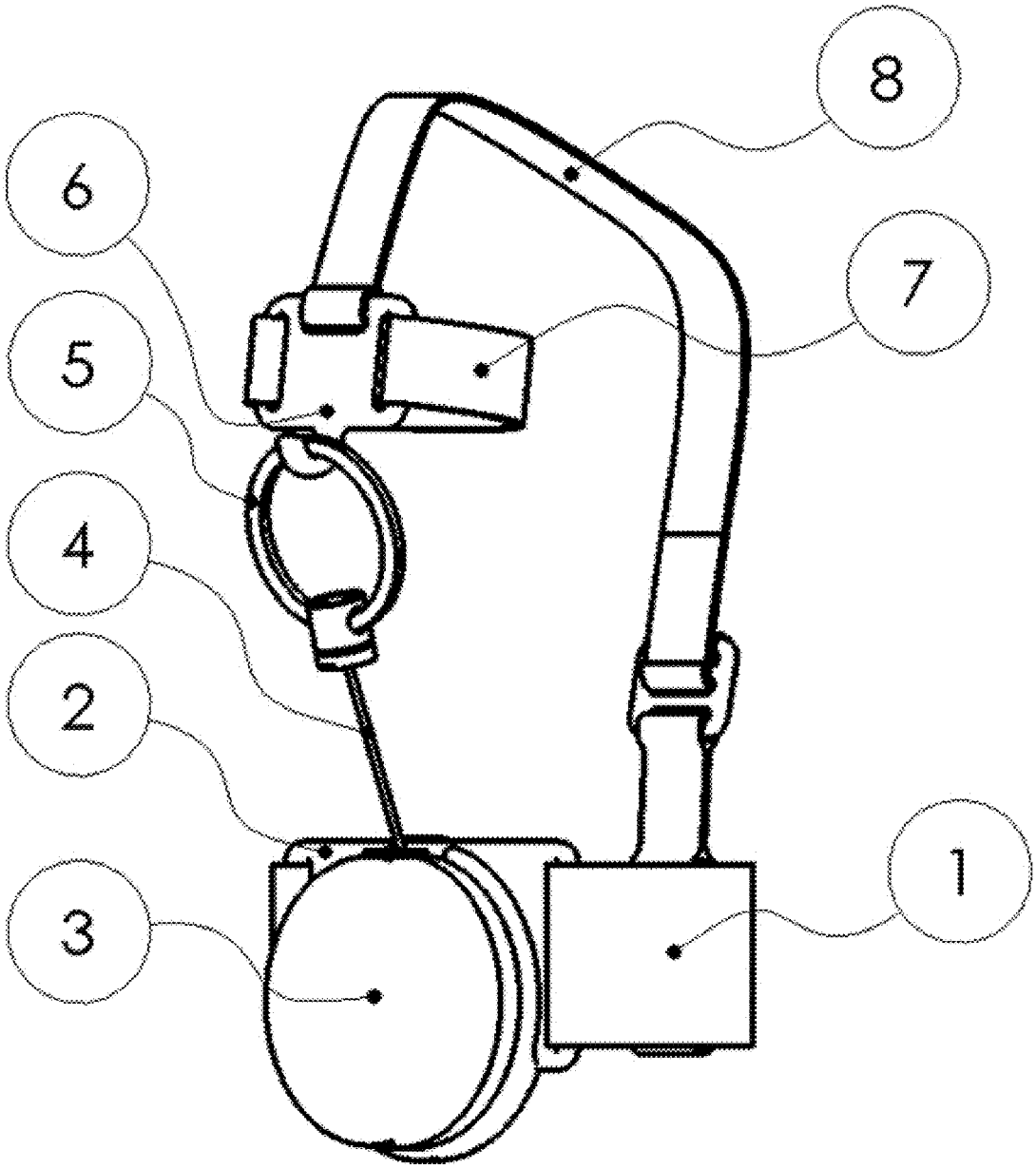
Figure 4:
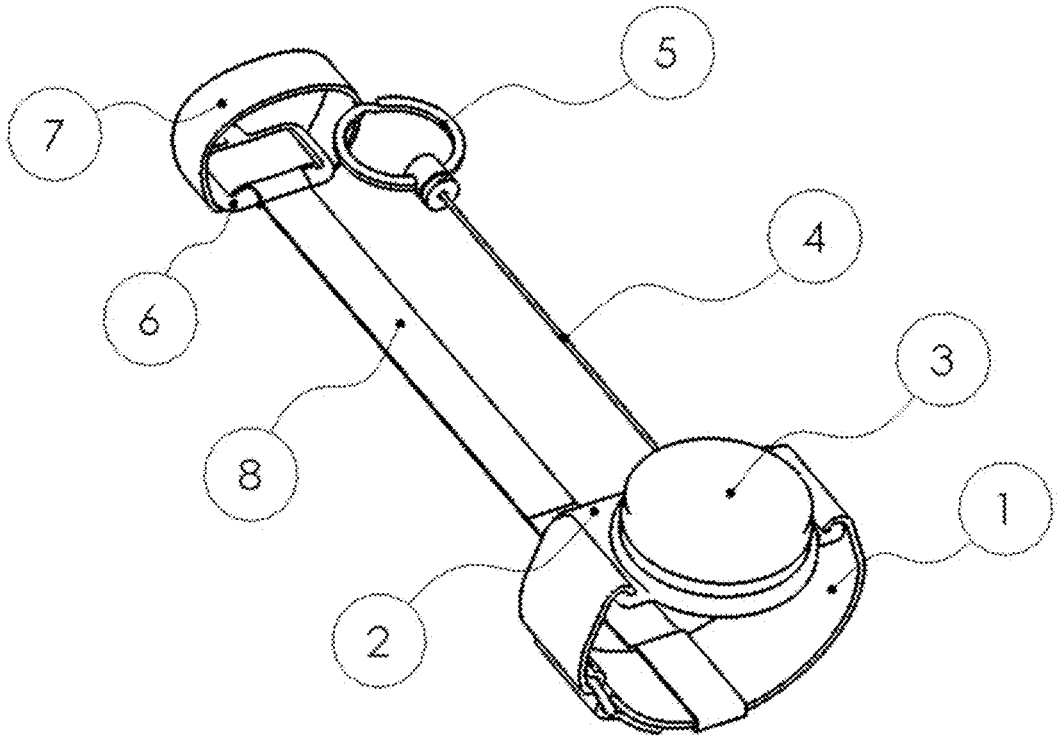
Figure 5:
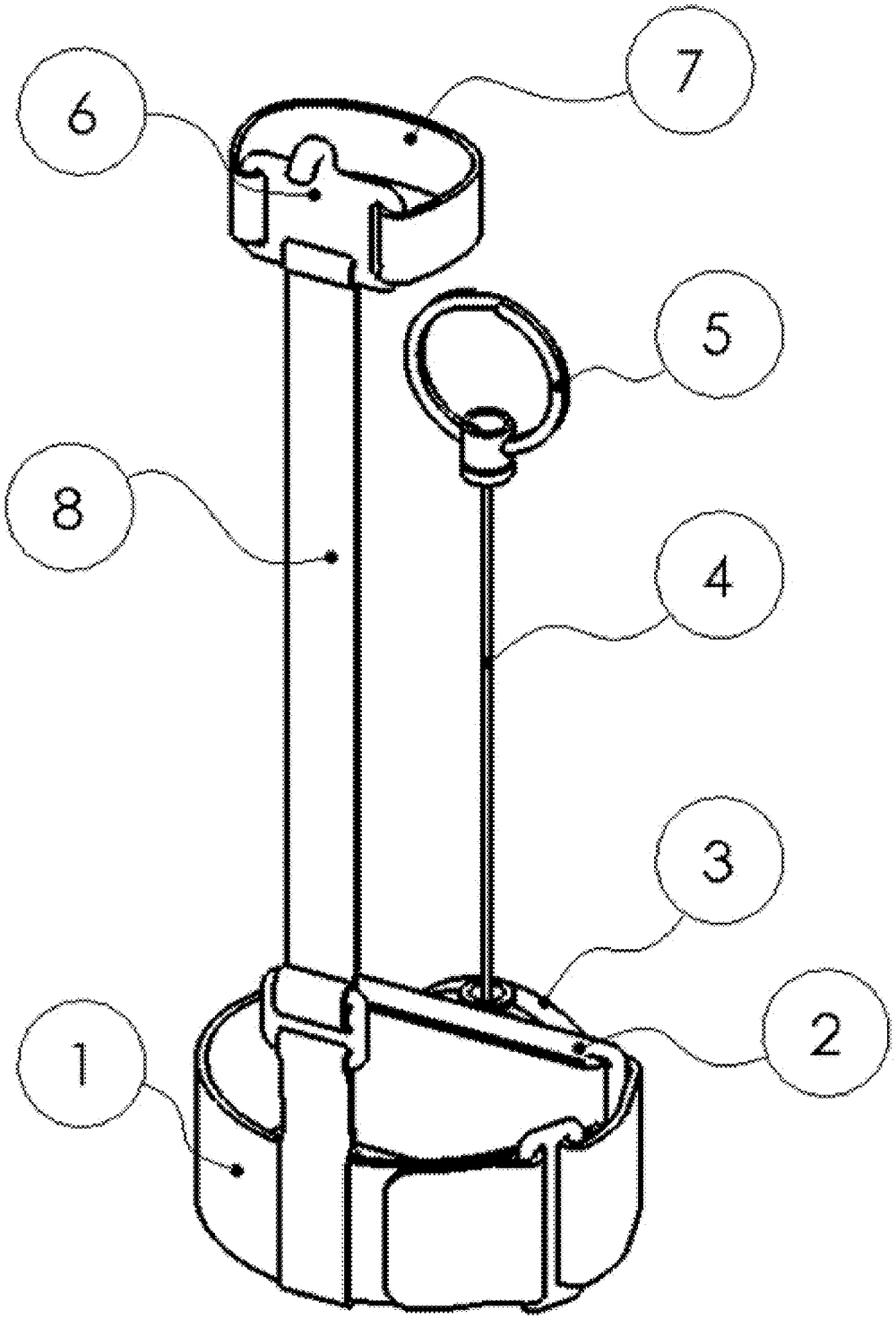
Figure 6:
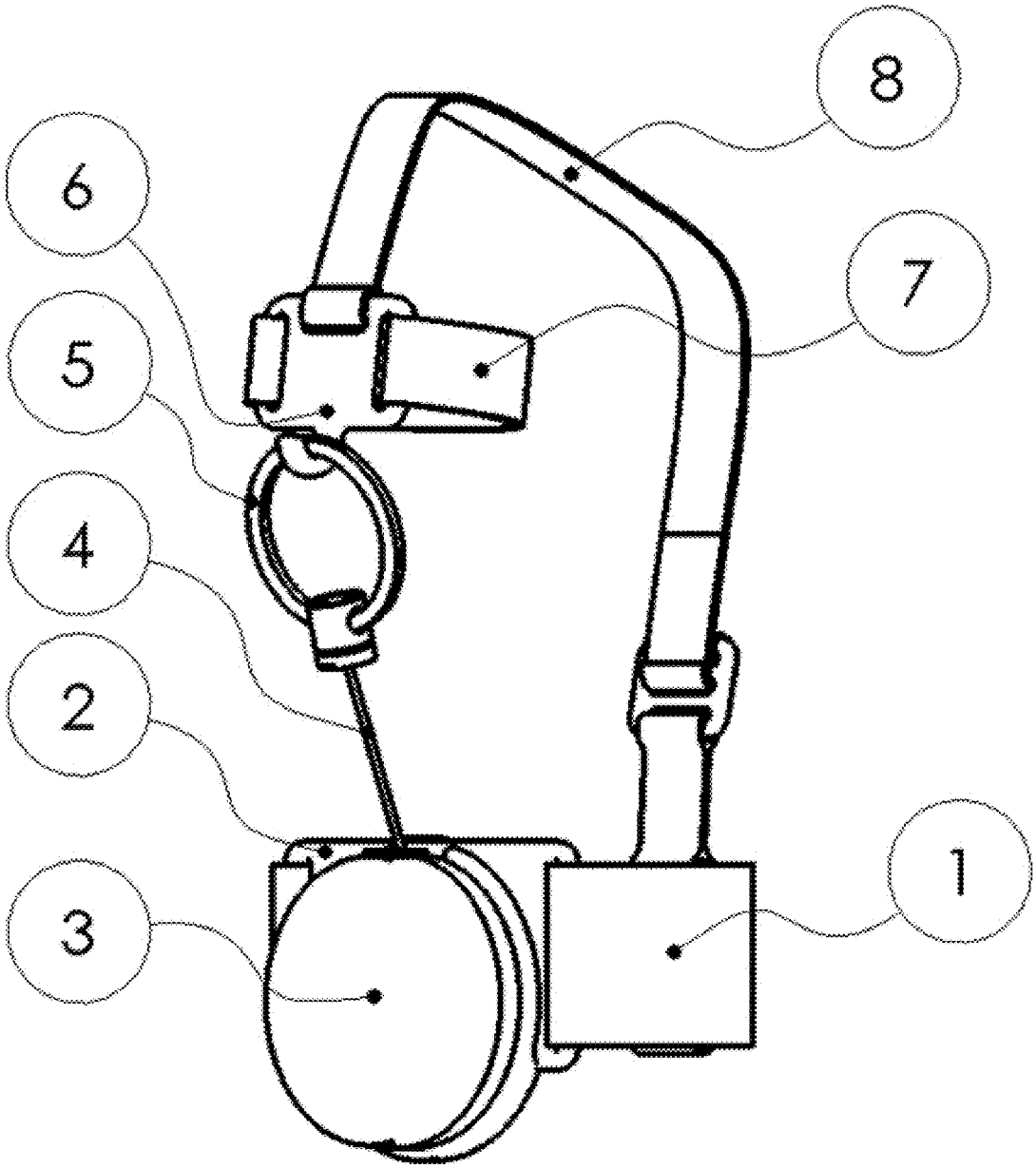
Figure 7:
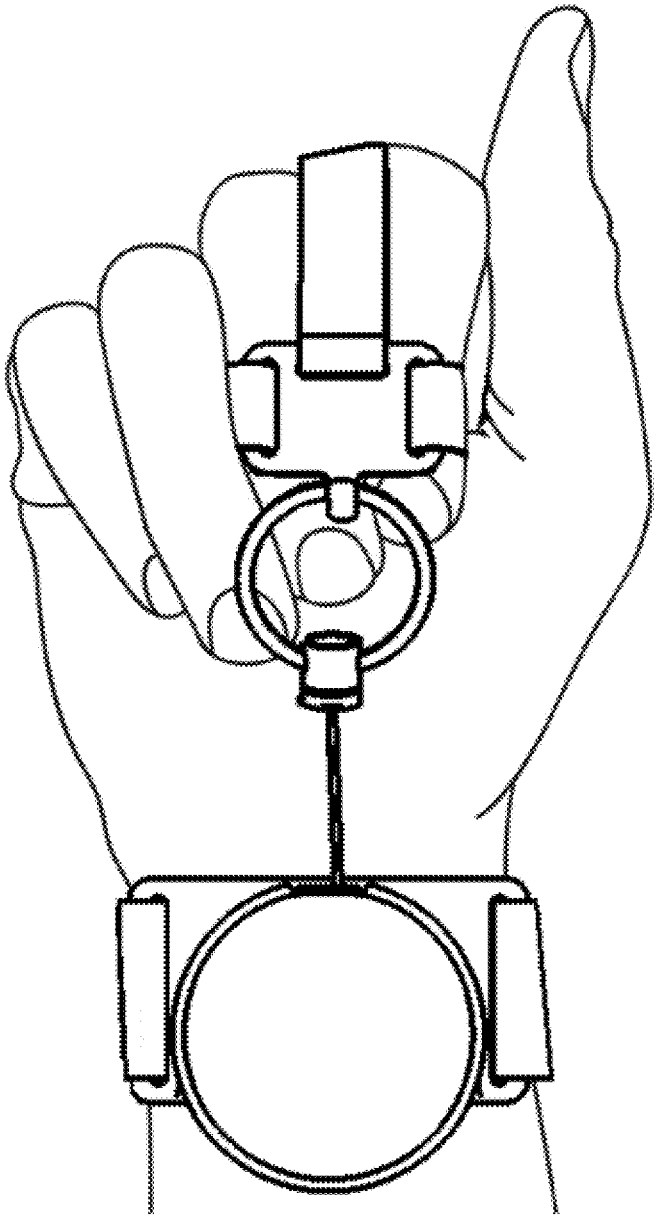
Figure 8:
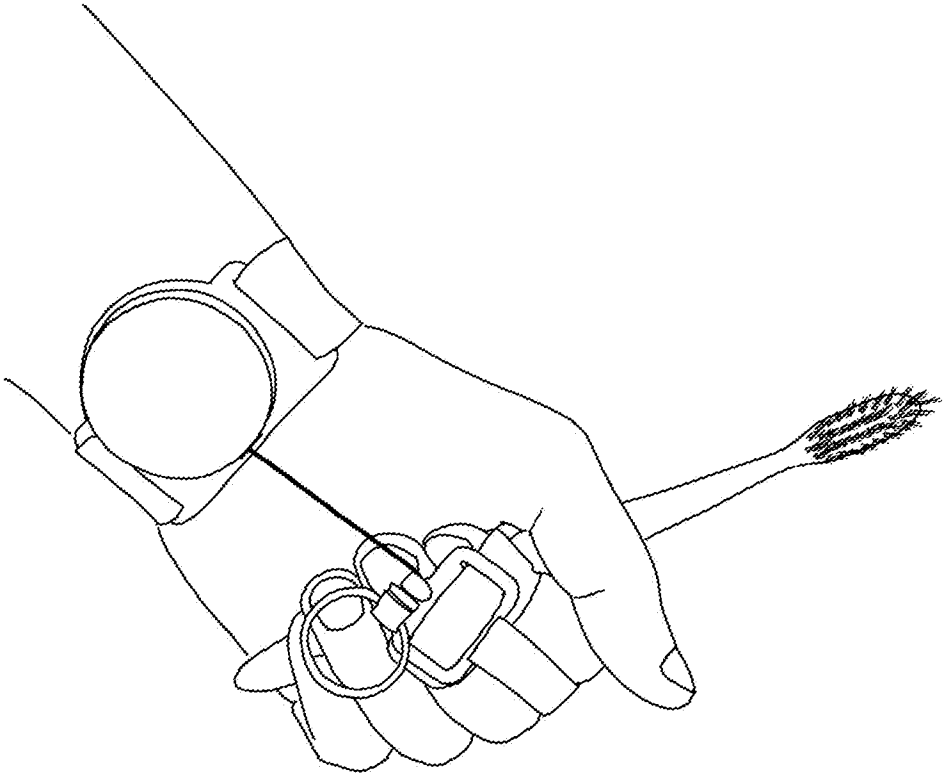
FIG. 8 shows an exemplary illustration of the device of FIG. 1 in use along with a brush.

FIG. 1 shows an exemplary grip exercise device on a hand according to the invention while FIGS. 2-7 are exemplary views of the device of FIG. 1. FIG. 2 shows eight components of the device of FIG. 1 in an open-hand configuration, while FIG. 3 shows the eight components in a hand-closed configuration.

FIGS. 2-7 illustrate one exemplary embodiment with the eight components:

a. An elastic bracelet 1, of sufficient length to encircle the wrists of any adult, and adjustable to size.

b. A semi-ovular, flexible bracelet, of sufficient lateral size to encompass at least one half of an adult's wrist of 38 millimeters front-to-back, with lateral slots running from end-to-end to accept the elastic bracelet; a sufficient cavity in the bracelet's center to hold a 40 millimeter diameter cylindrical spring actuator.

c. An enclosed, cylindrical spring actuator 3, measuring 40 millimeters in diameter and 11 millimeters tall, which pulls in a cable of a certain diameter when the cable is manually pulled out. The actuator can be a "spring motor" or "spring reel" or "spring-driven reel", or an electric motor. In one embodiment, the actuator can be a spring-loaded retractable spool, similar to those used in ID badge holders.

d. A steel or fiber cable 4 with exemplary dimension of 1 millimeter in diameter and at least 325 millimeters long.

e. A metal or plastic rigid circular loop 5 with an exemplary 20 millimeter loop diameter and 2 millimeter wire diameter.

f. A metal or plastic fingertip brace 6 with a rectangular profile measuring 1.5 millimeters thick, 28.5 millimeters wide in the lateral direction and 18.5 millimeters front-to-back; one slot at the far back running in the lateral direction measuring 12.5 millimeters long and 2 millimeters wide; two slots at the far left and right running from front-to-back, each measuring 13.5 millimeters long and 2 millimeters wide in the lateral direction; a bent hook at the center of the lateral direction at the far front curling upwards, measuring 4 millimeters wide in the lateral direction, curling 5 millimeters in the upwards direction, with a nominal hook diameter of 5 millimeters.

g. An elastic strap 7, in one embodiment 12.5 millimeters in width, of sufficient length to encircle the distal ends of any two adjacent fingers of any adult, and adjustable to size. The strap is covered with hook-and-loop material so that it can fold and attach to itself.

h. An elastic strap 8, in one embodiment 10 millimeters in width, of sufficient length to run from the distal ends of any two adjacent fingers to the wrist, along the dorsal side of the hand of any adult, and at both ends of the strap, double-slot buckles to form the ends of the strap into loops, adjustable in size.

This device augments the strength of the user's hand by attaching to the hand and exerting forces to hold and grasp objects. The grasping function can be easily engaged and disengaged, and the device is low-weight and low-profile. This embodiment creates useful grasping force for the user while being low weight, low physical profile, high function, and low cost.

This invention combines many of the desirable functional characteristics from passive and active grasping devices. It offers dynamic grasping force and a wide variety of objects to be held while maintaining a lightweight and low-profile physical form. It is easy for users to carry around during the day and alleviates many of the functional challenges encountered by people with compromised hand strength and mobility. It is soft, compliant, and adjustable, so a proper fit is guaranteed for all human hands.

Turning now to the figures, elastic bracelet (1) is threaded through the rubber bracelet (2), creating an adjustable bracelet. Spring actuator (3) is placed in the rubber bracelet's center cavity. One end of the cable (4) is inserted into the spring actuator (3). The rigid circular loop (5) is attached to the exposed end of the cable (4). The loop at one end of the elastic strap (8) is attached to the elastic bracelets (1). The loop at the opposite end of the elastic strap (8) is attached to the back-most slot of the fingertip brace (6). One end of the elastic strap (7) is attached to one of the far-lateral slots in the fingertip brace (6). The other end of the elastic strap (7) is attached to the other far-lateral slot in the fingertip brace (6).

The bracelet fits onto wrists, discreetly under shirt cuffs and adjusts to fit any size. The fingertip brace fits onto the index and middle fingertips and adjusts to fit any size using the finger elastic strap. When the rigid circular loop is pulled (using the opposite hand), it draws cable out of the spring actuator. When the circular loop is placed over the hook at the front of the fingertip brace, the spring actuator exerts a retraction force through the cable, pulling the fingertip brace and fingers into a grasping position. The dorsal elastic strap pulls backwards on the fingertip brace, redirecting the cable's force back to the dorsal side of the bracelet, preventing the fingertip brace from being pulled off of the fingers. When grasping force is no longer needed, the rigid circular loop is unhooked from the fingertip brace.

During assembly, the rigid circular loop is snapped onto the fingertip brace hook to engage grasping force. The dorsal elastic strap is shorter, and connects to a second finger elastic strap wrapped around the fingers, behind the proximal interphalangeal (PIP) joint instead of the dorsal side of the bracelet. The spring actuator could feature a locking mechanism to enable manual or automatic locking the cable's force and position. The spring actuator could feature an additional mechanism to allow the user to manually add tension to the cable to achieve greater or reduced grasping force. The spring actuator could feature a damping or frictional element to slow down the speed of cable retraction to improve ease of use. The spring actuator could be replaced with a simpler, linear elastic element. The spring actuator could be replaced with a linear or rotary electric actuator that either directly (cable) or indirectly (linkage, hydraulic, pneumatic, magnetic) applies force to the fingertip brace. The cable could have a sleeve or coating that improves its frictional performance when in contact with objects being grasped. One or more of the strap components could be consolidated to fewer components made of fabric, rubber, or other flexible material. The fingertip brace could attach to more or fewer fingers. Different fingers could be selectively engaged or disengaged from the grasping force. The fingertip brace or rigid circular loop could feature a quick-release mechanism to allow the user to easily disengage the grasping force without the use of the opposite hand. The lock formed between the fingertip brace and rigid circular loop could be electrically or otherwise automatically controllable so that other forms of input (e.g. voice command, timer timeout, inertial sensor, temperature sensor, etc.) could be used.

In other implementations, the dorsal elastic strap could be shorter and connect to a second finger elastic strap wrapped around the fingers, behind the proximal interphalangeal (PIP) joint instead of the dorsal side of the bracelet. In yet other implementations, the fingertip brace and/or strap could be designed such that it sufficiently holds onto the fingertips without the need for the dorsal elastic strap. The fingertip brace and strap could be removed by placing a hook or equivalent attachment point on the dorsal side of the bracelet and pulling the cable all the way over the fingers and down the dorsal side of the hand and placing the rigid elastic loop over that hook. As the cable retracts, the contracting loop would squeeze the fingers into a grasping position. In that variant, the cable and/or dorsal side of the hand may have a coating, sleeve, or geometry that minimizes the contact pressure and shear force between the cable and the user's skin.

In alternative implementations, the spring actuator could be replaced with a simpler, linear elastic element. The spring actuator could be replaced with a linear or rotary electric actuator that either directly (cable) or indirectly (linkage, hydraulic, pneumatic, magnetic) applies force to the fingertip brace. More than one cable or functionally equivalent mechanism could be used per hand. The spring actuator could be replaced with some other method of generating cable tension, such as body powder (e.g. wrist flexion/extension, elbow movement, shoulder movement, the opposite hand, etc.). One or more of the strap components could be consolidated to fewer components made of fabric, rubber, or other flexible material. The fingertip brace could attach to more or fewer fingers. Different mechanisms could be used to connect the cable to the fingertips during grasping and releasing. Examples include magnets, carabiners, hook-and-loop, grommets, clips, screws, locks, etc.

To use the device, a user slips her hand through band 1 and assembles the device as described above to fit onto the user's hand. When it is desired to grasp on to something, the user can: roughly align the hand wearing the device with the object to be grasped; using the opposite hand, pull on the rigid circular loop to draw out a sufficient length of cable to wrap around the object and meet the fingertip brace; snap the loop over the hook at the front of the fingertip brace; the grasping is now engaged, and the object can be acted upon. When it is desired to let go of the object: using the opposite hand, gently pull upwards on the rigid circular loop to disengage it from the fingertip brace; the cable and loop will quickly draw back into the spring actuator.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

Each embodiment disclosed herein may be used or otherwise combined with any of the other embodiments disclosed. Any element of any embodiment may be used in any embodiment.

While the invention has been described by way of example and in terms of the specific embodiments, it is to be understood that the invention is not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

The invention claimed is:

1. A hand exercise device, comprising:

a first wrist bracelet;

a wrist bracelet removably coupled to the first bracelet such that the first bracelet and the wrist bracelet form a loop which is configured to be positioned around a user's wrist;

an actuator mounted on the wrist bracelet with an extendable loop powered by the actuator;

a strap coupled to the first bracelet configured to be positioned opposite the wrist bracelet at a first end of the strap such that the strap is configured to extend along a back of a user's hand;

a fingertip brace coupled to a second end of the strap such that a finger is configured to be secured within a slot of the fingertip brace; and a bent hook coupled to the fingertip brace and arranged to face away from the wrist bracelet when the strap is in an extended position, wherein the extendible loop is configured to attach to the bent hook on the fingertip brace.

2. The device of claim 1, wherein the actuator comprises a cylindrical spring actuator that retracts the extendable loop.

3. The device of claim 2, comprising a cable coupling the actuator to the extendable loop, wherein the actuator pulls in the cable after the cable is pulled out of the actuator.

4. The device of claim 2, comprising a steel or fiber cable coupling the actuator to the extendable loop.

5. The device of claim 1, wherein the wrist bracelet comprises a semi-ovular rubber bracelet with lateral slots running from end-to-end to accept the first bracelet.

6. The device of claim 1, wherein the first bracelet is configured to be positioned on a top of a wrist and the wrist bracelet is on a bottom of the wrist.

7. The device of claim 1, wherein the fingertip brace comprises an elastic strap of a length configured to encircle a distal end of a user's finger.

8. The device of claim 1, wherein the fingertip brace comprises an elastic strap of a length configured to encircle distal ends of two adjacent fingers.

9. The device of claim 1, wherein the fingertip brace comprises an elastic strap of a length configured to encircle distal ends of one, two, or three adjacent fingers.

10. The device of claim 1, wherein the wrist bracelet is sewn or snapped on to the first bracelet.

11. The device of claim 1, wherein the actuator comprises a spring loaded reel.

12. The device of claim 1, wherein the actuator comprises a motor.

13. A hand exercise device, comprising:

a first bracelet;

a wrist bracelet removably coupleable to the first bracelet;

an actuator mounted on the wrist bracelet with an extendable loop powered by the actuator; and a fingertip brace coupled to the first wrist bracelet, wherein the extendable loop comprises a 20 millimeter loop diameter and a 2 millimeter wire diameter and wherein the fingertip brace comprises a rectangular profile measuring 1.5 millimeters thick, 28.5 millimeters wide in the lateral direction and 18.5 millimeters front-to-back; one slot at the far back running in the lateral direction measuring 12.5 millimeters long and 2 millimeters wide; two slots at the far left and right running from front-to-back, each measuring 13.5 millimeters long and 2 millimeters wide in the lateral direction; a bent hook at the center of the lateral direction at the far front curling upwards, measuring 4 millimeters wide in the lateral direction, curling 5 millimeters in the upwards direction, with a nominal hook diameter of 5 millimeters.

14. A method of holding an object, comprising:

attaching the first bracelet and wrist bracelet to a user's wrist, inserting a finger through the fingertip brace slot and attaching the extendable loop to the bent hook, and exercising the one or more fingers by alternately pulling the fingers into a palm of the user's hand and relaxing the finger and subsequently extending the fingers.

15. The method of claim 14, further comprising adjusting the strap band coupling the first bracelet to the fingertip brace.

16. A device, comprising:

means for attaching a hand exercise device to a wrist, the hand exercise device including a first bracelet;

a wrist bracelet removably coupled to the first bracelet such that the first bracelet and the wrist bracelet form a loop which is configured to be positioned around a user's wrist;

an actuator mounted on the wrist bracelet with an extendable loop powered by the actuator;

a strap coupled to the first bracelet configured to be positioned opposite the wrist bracelet at a first end of the strap such that the strap is configured to extend along a back of a user's hand;

a fingertip brace coupled to a second end of the strap such that a finger is configured to be secured within a slot of the fingertip brace; and a bent hook coupled to the fingertip brace and arranged to face away from the wrist bracelet when the strap is in an extended position, wherein the extendible loop is configured to attach to the bent hook on the fingertip brace means for inserting a finger through the fingertip brace and attaching the extendable loop to the bent hook, and means for exercising the fingers into a palm of the user's hand and relaxing the finger and subsequently extending the fingers.

17. The system of claim 16, wherein the extendible loop comprises a spring-actuated or motor-actuated cable configured to be attached to the bent hook across a palm-side of a hand such that a force from the cable is configured to bend a finger within the fingertip brace to conformally wrap around objects.

18. The system of claim 16, wherein the actuator is unpowered or powered.

* * * * *